US006116668A

United States Patent [19]

Carpol

[11] Patent Number: 6,116,668

[45] Date of Patent: Sep. 12, 2000

[54] ANIMAL SOLID WASTE COLLECTION

[76] Inventor: Nicholas Carpol, 1925 Century Park East #500, Los Angeles, Calif. 90067-2706

[21] Appl. No.: 09/351,975

[22] Filed: Jul. 12, 1999

[51] Int. Cl.[7] ..... A01K 29/00; A41D 19/00

[52] U.S. Cl. ..... 294/1.3; 294/25; 2/160; 383/4

[58] Field of Search ..... 294/1.3–1.5, 25; 15/104.8, 227; 2/16, 20, 158–160, 161.6, 161.7; 383/77, 4

[56] References Cited

U.S. PATENT DOCUMENTS

| | | | |
|---|---|---|---|
| 4,645,251 | 2/1987 | Jacobs | 294/1.3 |
| 4,805,242 | 2/1989 | Bolton | 2/160 |
| 4,845,781 | 7/1989 | Strickland et al. | 294/1.3 |
| 4,937,881 | 7/1990 | Heise | 294/1.3 |
| 4,959,881 | 10/1990 | Murray | 294/1.3 |
| 5,186,322 | 2/1993 | Harreld | 294/1.3 |
| 5,438,708 | 8/1995 | Jacovitz | 294/1.3 |
| 5,568,955 | 10/1996 | Giuliano et al. | 294/1.3 |
| 5,704,670 | 1/1998 | Surplus | 294/1.3 |

*Primary Examiner*—Dean J. Kramer
*Attorney, Agent, or Firm*—Erik M. Arnhem

[57] ABSTRACT

Solid animal waste can be removed from a carpet or other surface by a flexible garment worn on a person's hand and fore-arm. The garment includes a glove adapted to be worn on the person's hand and an open-mouthed bag extended from the glove for disposition around the person's forearm. When the animal waste is within the grasp of the glove, the bag can be turned inside out to enclose the glove and animal waste. Ties on the bag can be tied together to close the bag around the animal waste.

1 Claim, 2 Drawing Sheets

ANIMAL SOLID WASTE COLLECTION

BACKGROUND AND SUMMARY OF THE INVENTION

This invention relates to the collection and disposal of solid animal waste (feces), especially solid waste generated by pet animals such as dogs.

It is believed that in most cases solid waste produced by pet dogs is collected by means of a small shovel. The shovel is then emptied into a container for disposal. The process requires that the shovel be cleaned of any waste residue. Often the shovel is only partially cleaned, so that the partially cleaned shovel presents a sanitation problem for the dog (animal) owner.

The present invention provides a garment that can be worn on a person's hand for collecting and containerizing the solid waste in a single operation; the collected waste does not have to be transferred from the garment to another container for disposal purposes. This feature eliminates the sanitation problem, in that the collecting device does not have to be cleaned; the collecting device is an integral part of a disposable container for the solid waste.

In carrying out the invention, the garment is designed so as to include a glove adapted to be worn on a person's hand, and a bag extending from the glove for disposition around the person's forearm. After the person has picked up the solid waste in the glove, the bag can be turned inside out to enclose the glove and solid waste. The person can then remove the glove from his hand and secure the bag in a closed position, using two tie strips provided at the mouth of the bag.

The garment is preferably formed out of a low cost plastic film material having a film thickness of only about 0.002 inch. After the bag has been secured in the closed condition around the solid waste, the entire garment can be thrown away immediately, or stored for a short time and then thrown away. In preferred practice of the invention, a pouch containing a sanitizer pad is secured to the bag so that when the solid waste is removed from a carpet or other surface the sanitizer pad can be used to remove residues from the surface, the sanitizer pad can be thrown into the bag for disposal with the solid waste.

Specific features of the invention will be apparent from the attached drawings and description of a particular embodiment of the invention.

DESCRIPTION OF A PREFERRED EMBODIMENT OF THE INVENTION

Figure 1:
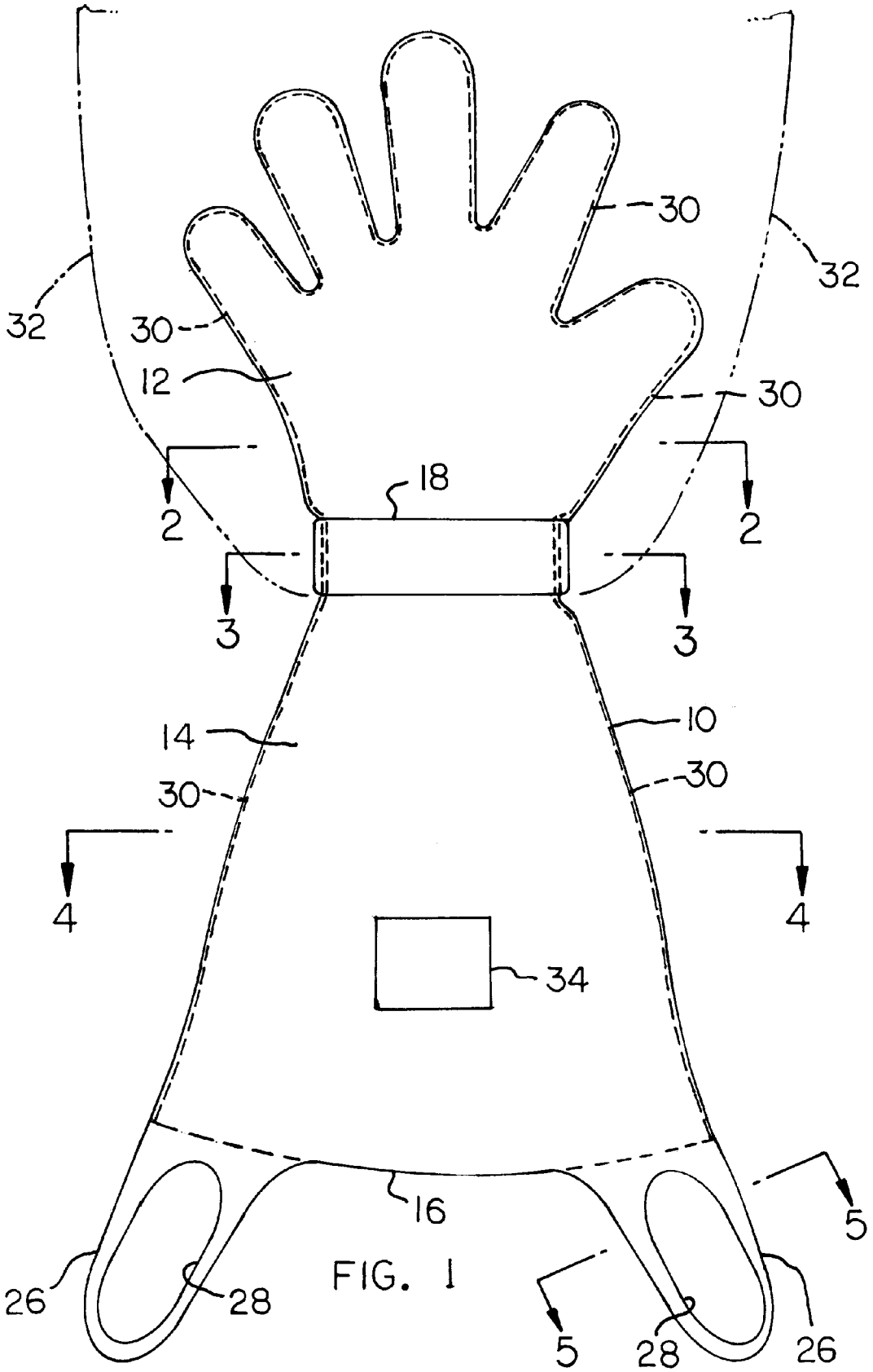
FIG. 1 is a plan view of a hand garment constructed according to the invention.
Figure 2:
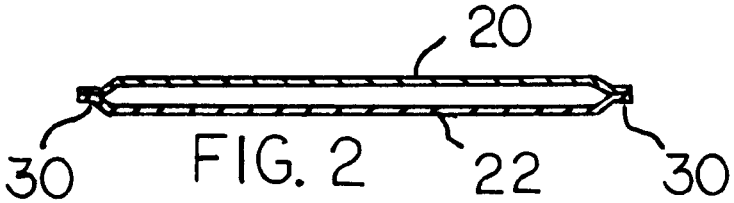
FIG. 2 is a transverse sectional view taken on line 2—2 in FIG. 1.
Figure 3:
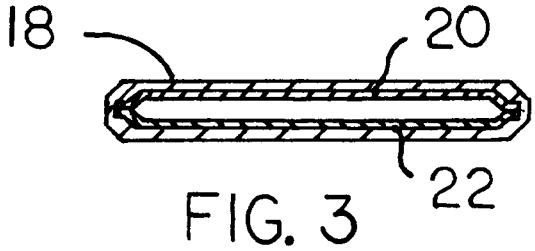
FIG. 3 is a sectional view taken on line 3—3 in FIG. 1.
Figure 4:
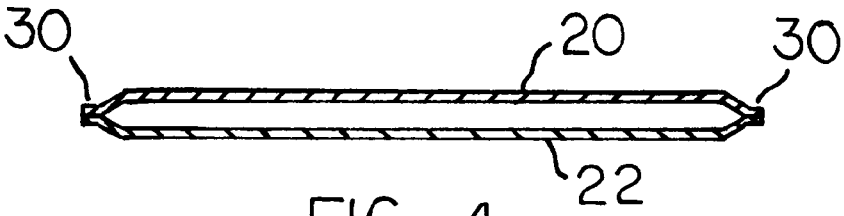
FIG. 4 is a transverse sectional view taken on line 4—4 in FIG. 1.
Figure 5:
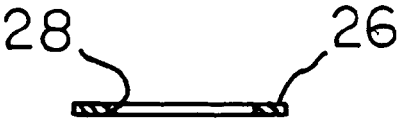
FIG. 5 is a fragmentary sectional view taken on line 5—5 in FIG. 1.

Referring to FIG. 1, there is shown a plan view of a flexible garment 10 embodying the invention. The flexible garment includes a glove 12 adapted to be worn on a person's hand, and a hollow bag 14 extending from the glove for disposition around the person's forearm.

Glove 12 comprises five sockets (or sleeves) adapted to envelope the person's thumb and fingers, whereby the person is enabled to pick up solid animal waste without coming into direct contact with the waste. Hollow bag 14 comprises an annular plastic film adapted to encircle the wearer's forearm, from the wrist up to approximately the person's elbow. Bag 14 has an open mouth 16 that enables the garment to be inserted over the forearm onto the person's hand. Bag 14 forms a continuous integral hollow in extension of glove 12.

At the juncture between glove 12 and bag 14 there is a wrist band 18 loosely encircling the person's wrist. Preferably, glove 12 and bag 14 are formed out of two plastic sheets 20 and 22 having generally similar plan shapes. The two plastic sheets have the shapes depicted in FIG. 1, except that sheet 20 has two extensions 26 that form tie strips adapted to secure the bag in a closed condition. Each extension 26 has an elongated opening 28 therein that facilitates folding of the respective strip. Each extension 26 forms a flexible handle for bag 14.

Each plastic sheet 20 or 22 had its side edges secured to the associated edges of the other sheet, as indicated by dotted lines 30 in FIG. 1; the securements can be effected by adhesives or by heat bonding. Each plastic sheet is preferably a relatively thin plastic film having a thickness of about 0.002 inch. The film thickness is not critical, except that each sheet should be relatively flexible. For cost reasons the film thickness should be as small as possible, e.g. about 0.002 inch. The two sheets are left unconnected at bag mouth 16.

At the juncture between glove 12 and bag 14, there is a flexible wrist band 18. The band is preferably a plastic adhesive tape material encircling the plastic garment to provide a relatively inflexible band between glove 12 and bag 14. The plastic films 20 and 22 that form glove 12 and bag 14 extend within and through wrist band 18 so that the opposed walls of the glove and bag are continuous, i.e. the glove and bag are formed of two continuous sheets 20 and 22 that are connected at their side edges (as indicated by the dashed lines in FIG. 1).

Wrist band 18 is formed of a plastic adhesive tape having the adhesive surface presented to sheets 20 and 22 at the juncture between glove 12 and bag 14. The wrist band 18 completely encircles the plastic garment to form a relatively inflexible connection between glove 12 and bag 14.

As shown in FIG. 1, bag 14 flares from wrist band 18 to open mouth 16; i.e. the perimeter dimension of the bag progressively increases from band 18 to open mouth 16. This flaring configuration is designed into the garment to facilitate the process of turning the bag 14 inside out, as denoted by numeral 32 in FIG. 1.

While glove 12 is being used to pick up (collect) solid animal waste, bag 14 is in the FIG. 1 full line position (condition). The flaring shape of the bag enables the bag to have a desired clearance with the person's shirt sleeve (or coat-sleeve). After the solid waste (feces) is within glove 12, the person uses his other hand to turn bag 14 inside out, to the condition depicted by dashed line 32. Handles (extensions) 26 can be selectively pulled to achieve the inside-outside turning of bag around the juncture with wrist band 18. Band 18 remains essentially immovable on the person's wrist (with enough clearance to permit glove 12 to be later removed from the person's hand).

When bag 14 is in the inside-out condition depicted by numeral 32, the two handles 26 can be gripped by the person's other hand, while the gloved hand is- drawn out of glove 12. Thereafter, handles 26 can be crisscrossed and tied together to close bag 14 and seal the animal waste within the bag. The garment can then be placed in the garbage can for disposal purposes.

During the process of lifting the animal solid waste from the rug or floor surface, some waste residue can remain on the surface. In order to facilitate cleaning of this surface, a mat (or paper cloth) saturated with a cleaner or sanitizer solution, can be applied to the soiled surface. The garment shown in FIG. 1 can be equipped with a small rectangular pouch 34, located on the outer side surface of bag 14. Pouch 34 contains a small cloth or pad saturated with a sanitizer (or cleaner) solution. Pouch 34 can be a square envelope formed of paper, and of sufficient size to contain a small cleaning cloth folded to a square shape, about one inch on a side. Pouch 34 can be similar to the pouch commonly used in restaurants to contain sugar. The cleaning cloth can be removed from pouch 34 by tearing the pouch along a pouch side edge. The cleaning cloth is preferably removed from the pouch prior to the process of collecting solid animal waste from a rug, carpet or other surface in the home (or outside the home).

The garment depicted in the drawings is worn on the person's hand and forearm, i.e. glove 12 fits over the person's hand, while bag 14 fits over the person's forearm; mouth 16 is located slightly above the person's elbow. The length of bag 14, measured from band 14 to open mouth 16 is somewhat greater than the length of glove 12, measured in the opposite direction from band 18, in order that when bag 14 is turned inside out (as indicated by numeral 32) the bag will completely enclose glove 12 When the person withdraws his hand out of glove 12, the animal waste will remain in the glove. As previously noted, extension strips (handles) 26 can be folded and tied together, to secure the bag in a closed condition.

Having described my invention, what I claim is as follows:

1. A disposable single-usage device for collecting and containerizing animal solid waste comprising:

a flexible garment that includes a glove adapted to be worn on a person's hand, a bag extending from said glove for disposition around the person's forearm and a wrist band encircling the garment at the juncture between the glove and the bag; said wrist band being formed of a tape material having an adhesive surface in contact with an outer surface of said garment;

said band rigidifying the juncture between the glove and the bag;

said garment being formed of a flexible material, so that when the person has collected animal solid waste in the glove, the bag can be turned inside out around the juncture between the band and the bag, so as to close the bag around the solid waste; and a tear-open pouch containing a sanitizer cleaning element located on an outer surface of said bag so that the sanitizer cleaning element is removable from the pouch and available for cleaning a surface soiled by the solid waste.

* * * * *